US005702778A

United States Patent [19]

Andonian

[11] Patent Number: 5,702,778

[45] Date of Patent: Dec. 30, 1997

[54] GIFT-PACKAGE ORNAMENT

[76] Inventor: Thomas Gary Andonian, P.O. Box 38473, Los Angeles, Calif. 90038

[21] Appl. No.: 671,948

[22] Filed: Jun. 28, 1996

[51] Int. Cl.[6] ..... A63H 33/26

[52] U.S. Cl. ..... 428/5; 428/16; 428/900

[58] Field of Search ..... 428/7, 16, 900, 428/5

[56] References Cited

U.S. PATENT DOCUMENTS

| | | | |
|---|---|---|---|
| D. 185,883 | 8/1959 | Liberty | 428/16 X |
| 2,736,115 | 2/1956 | James | 428/5 X |
| 3,660,926 | 5/1972 | Lerner et al. | 428/900 X |
| 4,091,565 | 5/1978 | Sheehan | 428/900 X |
| 4,971,278 | 11/1990 | Woods | 428/900 X |

OTHER PUBLICATIONS

Advertisement for small statues with gold elastic ribbon, p. 93, Jun. issue of "Gift and Decorative Accessories" magazine, Jun. 1996.

*Primary Examiner*—Henry F. Epstein
*Attorney, Agent, or Firm*—Cislo & Thomas LLP

[57] ABSTRACT

A gift-package ornament for enhancing the decorative appearance of a gift utilizing a unique design style and method of application not before seen in the gift and stationery industries. A gift-package ornament has an upright figure and a flexible base. The flexible base allows the upright figure to be held upright so that the upright figure may stand away from the surface of the gift package. The flexible base may be made of malleable metal and configured so that it is generally parallel to the upright figure during transport and storage, yet perpendicular to the upright figure so that it may stand upright and away from the surface of the gift package. The flexible base is attached to the rear of the gift-package ornament. Adhesive on the flexible base serves to affix the gift-package ornament to the gift. The rear of the gift-package ornament is of paper or other material upon which indicia can be written so an inscription or the like may be made as for a greeting card to the recipient of the gift from its giver. The upright figure may incorporate a magnetic sheet so that, when separated from the flexible base, the upright figure may act as a refrigerator or kitchen magnet or the like, extending the useful life of the upright figure. Fanciful and attractive caricatures may be presented by the upright figure, with small holes in the upright figure allowing it to snugly hold ribbons or the like. The snug holding of ribbons allows the upright figure to interact with the gift package. Such apparent interaction may be complemented by the disposition or appearance of the caricature itself. Plastic lamination may be used to protect the caricature, and the upright figure may be die cut to provide sharp and clean edges.

16 Claims, 3 Drawing Sheets

GIFT-PACKAGE ORNAMENT

BACKGROUND OF THE INVENTION

1. Field of the Invention

This invention relates to gift-package decorations and, more particularly, to an ornament for a gift package that stands upright to present the ornament and enhance the attractiveness of the gift package.

2. Description of the Related Art

On special occasions such as parties, holidays, and the like, it is common for people to exchange gifts that are wrapped in brightly-colored paper and ribbons that hide the gift and add a festive and attractive appearance to the gift so wrapped. Christmas and birthday presents are but two kinds of presents that are generally so wrapped. The wrapping of a gift provides an element of surprise to the person to whom the gift is given as the contents of the gift are not known until the wrapping paper and ribbons are removed.

Many people enjoy giving and receiving gifts. The pleasant anticipation that sometimes arises when a person is expecting or sees the presence of a gift may be enhanced by the decorative wrapping surrounding the gift. As friends and relatives may enjoy the reaction obtained when a festively wrapped gift is given, there are those who spend some time and take some pains to wrap and decorate a gift in as attractive a manner as possible.

Previously, wrapping paper, ribbons, and other decorations have been used to wrap and decorate gifts. Additionally, greeting cards are sometimes combined with gifts so that the gift recipient is able to enjoy both the greeting card and the gift. However, no prior device is known to exist that provides a festive and merry ornament that stands upright and away from the surface of a gift. Such an ornament would add to the visual attractiveness of the wrapped gift and could exhibit a number of different caricatures befitting humorous and or otherwise appropriate figures that lend themselves to the happiness of the occasions where gifts are given or exchanged.

It would be additionally advantageous if such an ornament could be detached from its base after use as an ornament for a gift so that it may serve as a refrigerator magnet or the like. Such a gift-package ornament should be easily transportable, as by having a flexible base, and could appear to engage other parts of a wrapped gift, such as ribbons or the like, to add visual interest and attraction to the wrapped gift.

SUMMARY OF THE INVENTION

The present invention resides in a gift-package ornament that serves to enhance the attractiveness and festivity often associated with attractively wrapped gifts. Easily shipped and transported as it assumes a generally flat configuration, the gift-package ornament of the present invention has a flexible base that extends from a parallel configuration to a perpendicular configuration to allow the laminated caricature of an upright figure to assume a standing, or erect, position. A portion of the flexible base is adhesive and covered by a non-adhesive strip. When the non-adhesive strip is removed, the flexible base and upright figure may be adhesively attached to the gift.

The upright figure may take several forms and may bear several different types of caricatures. The construction of the different upright figures is generally the same with a paper graphic or print laminated on both sides by plastic. The plastic laminating the front side of the caricature is clear so that the graphic or print may be seen through the lamination. A sheet of magnetic material then backs the rear of the laminated caricature. Paper is then used to back the magnetic sheet and provides means by which an inscription may be made to the receiver of the gift or may bear a humorous or other type of greeting from the manufacturer. Such a prescribed greeting may bear closely and humorously upon the caricature or its expression on the front side of the upright figure.

To enhance the appeal and attractiveness of the gift-package ornament of the present invention, small holes, or apertures, may be present that allow the gift-package ornament to engage ribbons associated with the wrapped gift and to snugly hold them in place so that the upright figure appears to be interacting with the ribbons. Additionally, the caricature may be formed so that its shape, appearance, or expression appears to be derived from its presence atop the gift or in otherwise apparent engagement with its surroundings atop the gift.

The die-cut nature of the gift-package ornament of the present invention enhances its attractiveness by giving it sharply defined and crisp edges. Once the gift has been unwrapped and the gift-package ornament has served its purpose, the flexible base may be removed from the paper backing of the upright figure. The magnetic sheet incorporated into the upright figure allows the upright figure to act as a refrigerator magnet or the like to enhance the useful nature of the present invention and to act as a memorabile, or memento, of the festive event and the accompanying gift.

Due to the laminated, magnetic, and inscribable nature of the present invention, the gift-package ornament set forth herein provides new means by which packages may be decorated and festive and pleasant surprise elicited from recipients of such gifts.

OBJECTS OF THE INVENTION

It is an object of the present invention to delight and surprise recipients of gifts by providing a heretofore unseen gift-package ornament.

It is another object of the present invention to provide a gift-package ornament that is easily affixed to a gift and is self-supporting.

It is another object of the present invention to provide a gift-package decoration that is unique from all other gift decorations in that it stands upright on a package.

It is an additional object of the present invention to provide a gift-package ornament that interacts or appears to interact with the gift to which it is attached and/or to the package's wrapping elements, such as ribbon or the like.

It is yet another object of the present invention to provide a gift-package ornament that may take several different embodiments in the form of different caricatures.

It is an additional object of the present invention to provide a gift-package ornament that may also act as a greeting card or the like as well as a magnet as for refrigerators.

These and other objects and advantages of the present invention will be apparent from a review of the following specification and accompanying drawings.

DESCRIPTION OF THE PREFERRED EMBODIMENTS

The present invention resides in an attractive gift-package ornament by which gifts or other packages may be decorated in a manner that complements the gift and may elicit a pleased or anticipatory reaction from the person who is receiving the gift. The person who is giving the gift may also enjoy providing the gift recipient with a gift showing the warmth, affection, and/or esteem in which the gift recipient is held by the gift giver. The gift-package ornament is made of durable materials and, upon removing the flexible base, may serve as a kitchen or refrigerator magnet, or the like.

Figure 1A:
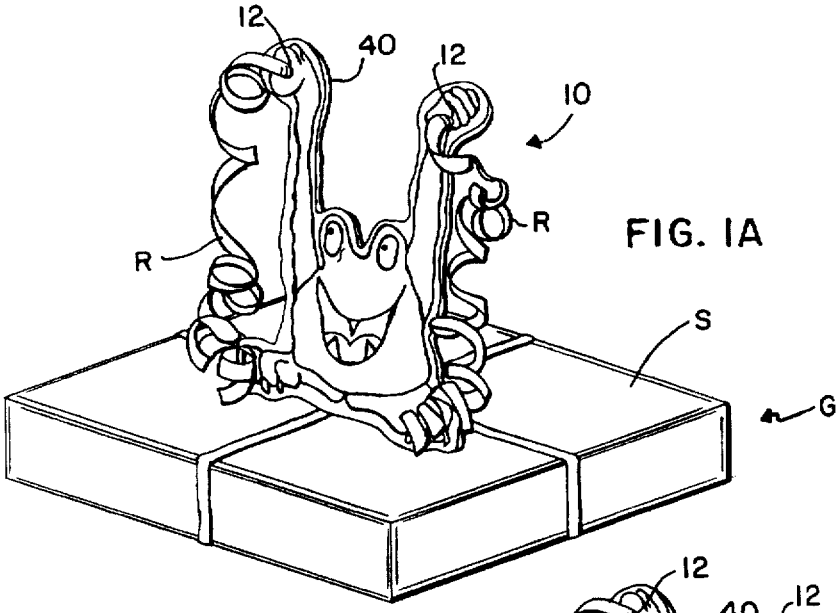
FIG. 1A shows a perspective view of a first embodiment of the gift-package ornament of the present invention as it may be used atop a gift package.
Figure 1B:
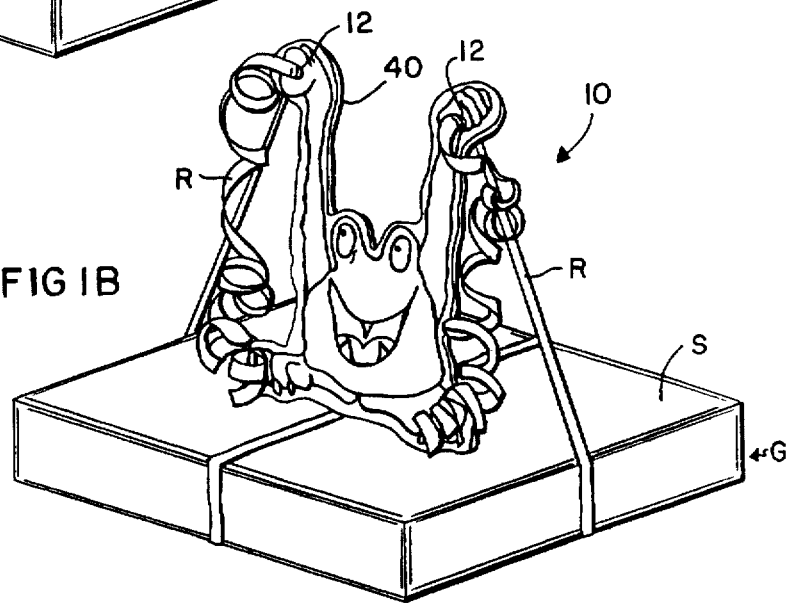
FIG. 1B shows a perspective view of the first embodiment of FIG. 1A independently holding a ribbon to the gift package.

As shown in FIGS. 1A and 1B, the gift-package ornament 10 may sit, rest, or otherwise be affixed to a surface S of a gift G so that it may be prominently displayed and easily viewed. Ribbons R or the like may be engaged by the gift-package ornament 10 through appropriately placed holes 12 or the like. As shown in FIGS. 1A and 1B, the gift-package ornament 10 may hold ribbon R so that the ribbon R is held to the package by a separate knot or the like adjacent the gift-package ornament 10 (FIG. 1A) or the gift-package ornament 10 may independently serve as the ribbon holder in place of any knot or other fixed element (FIG. 1B).

For exemplary purposes, the embodiment used to describe the gift-package ornament of the present invention is a caricature of a monster that may be purple in color; however, as is shown in FIGS. 5A–5I, several other embodiments with different caricatures are also contemplated in the present invention. For purposes of the present description, the gift upon which the purple-monster gift-package ornament is affixed may be considered a child's birthday gift. A complementing inscription on the back of the ornament may read, "Happy Birthday! Hope it's a monster bash!" Alternatively, the gift may be considered a Halloween gift in accordance with the motif lent to the package by the monster embodiment. For a Halloween gift, the inscription may be changed as appropriate.

Figure 2:
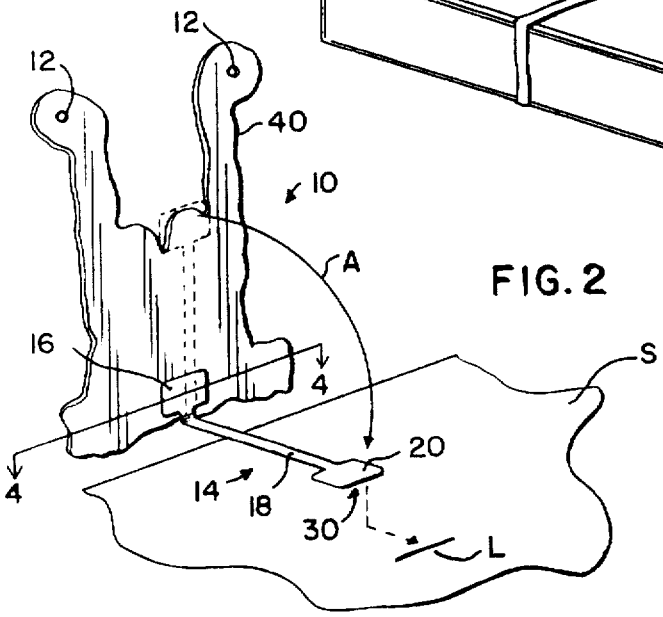
FIG. 2 shows a rear perspective view of the gift-package ornament of the present invention, showing the flexible base. The phantom lines show the base when it is in an upright position parallel to the gift-package ornament.

As shown in FIG. 2, a flexible base 14 may protrude perpendicularly to the plane defined by the upright figure 40 of the gift-package ornament 10. This places the flexible base 14 generally parallel to the surface S of the gift G. The flexible base 14 is attached at its proximal end 16 to the back of the gift-package ornament 10, preferably near its bottom. A central extension 18 serves to provide a longer support base for the gift-package ornament 10 and to connect the distal end 20 to the proximal base end 16.

The flexible base 14 may be made of a soft but generally resilient material such as aluminum or other soft and bendable metal or resilient plastic. Malleable materials such as soft metals are generally considered best for use in the flexible base 14 as they have a tendency to maintain their shape and configuration once they are bent to the desired shape or configuration.

As shown in FIG. 2 by the phantom lines, the flexible base 14 may be bent so that it is generally parallel to the plane of the gift-package ornament 10. This configuration of the flexible base 14 with respect to the gift-package ornament 10 allows for easy transport, storage, and packaging of the gift-package ornament 10. This configuration also provides for easy merchandise displays. Once the gift-package ornament 10 is removed from the packaging that may accompany it and is ready to be attached to the gift G, the flexible base 14 may be bent downward along the lines of the arrow A shown in FIG. 2 so that the flexible base 14 is transformed from its parallel configuration to its perpendicular one.

Figure 3:
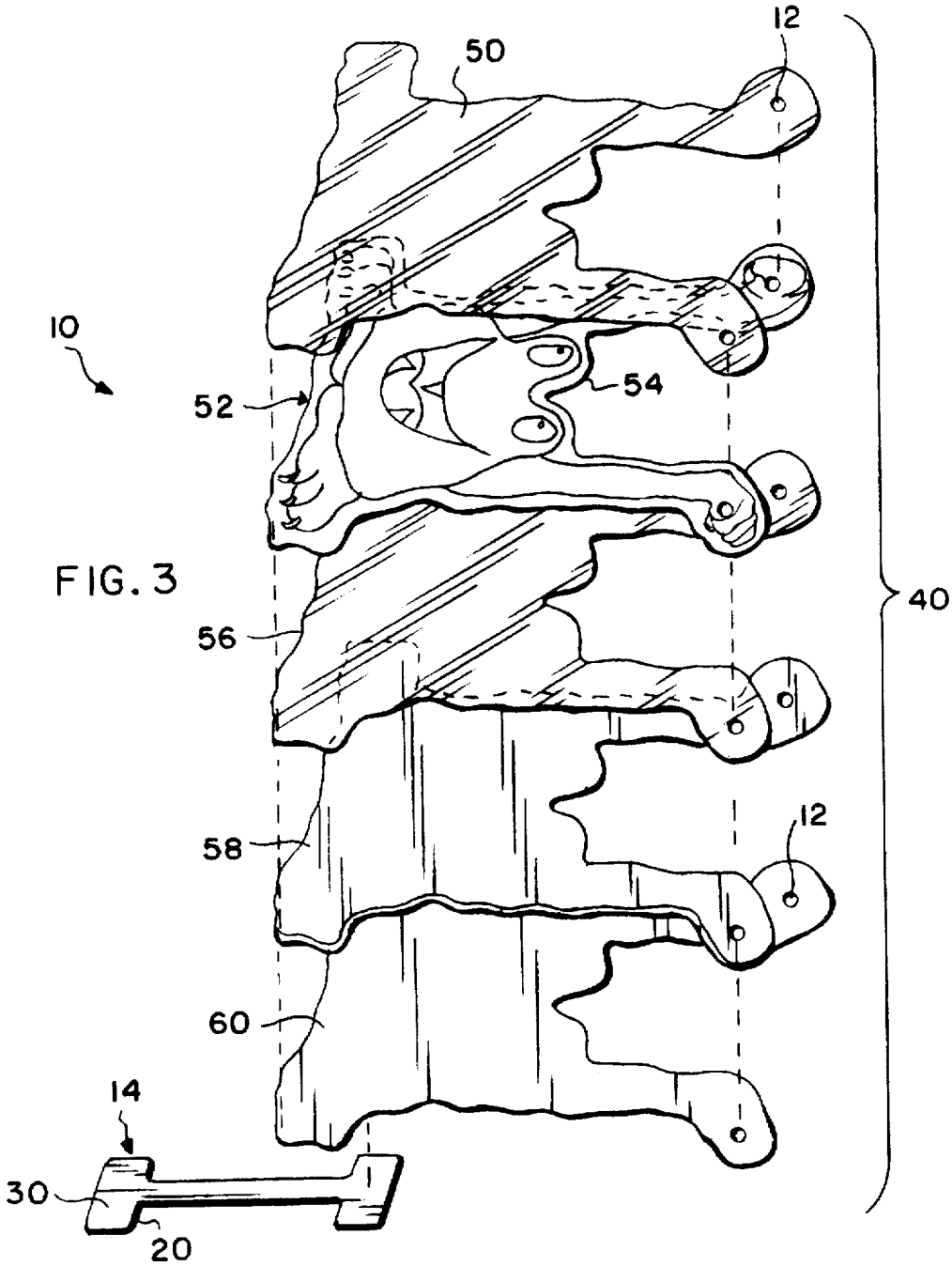
FIG. 3 shows an exploded view of the gift-package ornament of FIG. 1 with the flexible base shown in a configuration as when initially applied to the gift-package ornament.

In an alternative embodiment, the gift-package ornament 10 may appear to be lifted up and away from the surface S of gift G by bending the flexible base 14 so that it is straight as shown in FIG. 3. The distal base end 20 is then bent at its juncture with the central base extension 18 so that the central base extension 18 serves to lift the upright figure of the gift-package ornament 10 up and away from the surface S of gift package G. The distal base end 20 is then attached to the gift package in a manner as set forth in more detail below.

At the end of the distal base end 20 is an adhesive that serves to attach the downward-facing surface 30 of the distal base end 20 to the gift package. The adhesive layer (not shown) may be covered with a non-adhesive strip so that the adhesive maintains its adhesiveness during production, packaging, transport, storage, and at all times prior to use. When the gift-package ornament 10 of the present invention is to be used, the gift-package ornament is made ready for attachment to the gift G. When all is ready, the non-adhesive strip is removed from the downward-facing surface 30 to expose the adhesive and made it ready for contact and adhesion with the gift G.

Once the flexible base 14 has been extended, the gift giver may easily inscribe a handwritten greeting on the back of the upright figure 40. When the inscription is finished, a small slit L may be cut in the wrapping paper surrounding the gift G. Distal end 20 may be passed through the small slit L to engage the underlying gift or other wrapping paper. By pressing the adhesive present on the distal base end 20 to the gift G, the upright figure 40 may be held upright and erect so that it stands away from the surface S of the gift G. The majority of the flexible base 14 may be hidden from sight to enhance the free-standing appearance of the gift-package ornament 10 by inserting the central base extension 18 as far as it will go into the small slit L and until the small slit L engages the upright figure 40 and/or the proximal base end 16.

As shown in FIGS. 2 and 3, the gift-package ornament 10 of the present invention has basically two primary components. The first component is the upright figure 40, which is the prominently displayed portion of the gift-package ornament 10 and is of primary focus as it is that which elicits the favorable or emotional responses of the persons exchanging the gift when it serves to decorate the gift G. Secondly, the flexible base 14 is generally attached to a lower rear portion of the upright figure 40 in order to prop up directly the upright FIG. 40. The attachment made by the flexible base 14 to the upright figure 40 may be similar to that of the adhesive attachment between the distal end 20 of the flexible base 14 and the gift G.

In the preferred embodiment, the upright figure 40 is constructed so that it is lightweight, resilient, visually attractive, safe, nontoxic, and constructed in a manner that will complement the gift to which the gift-package ornament 10 is attached. FIG. 3 shows the construction of the gift-package ornament 10 in exploded view.

In FIG. 3, a first, top, and clear plastic lamination 50 overlies paper or other printable material 52 upon which a graphic figure is printed, such as a caricature 54. The caricature serves to enhance the gift G and may be drawn and colored to markedly enhance the attractive and/or pleasing appearance presented by wrapped gift. A second and rear lamination 56 made of plastic or the like serves to coat and protect the rear portion of the paper cutout 52. The resulting laminated paper cutout is placed atop a magnetic sheet 58 which itself is backed by a sheet of paper 60 or the like. It is to the rear of this paper backing sheet 60 that the proximal base end 16 is attached. The paper sheet 60 is used in order to provide means by which indicia or the like, such as a greeting, may be inscribed upon the back of a gift-package ornament 10 in order to more personalize it to the gift recipient and to make it a more attractive article. By allowing the inscription of indicia and the like upon the paper backing sheet 60, the gift-package ornament 10 of the present invention also serves to a significant extent as a greeting card. Additionally, a pre-printed greeting or other indicia may be inscribed upon the paper backing sheet 60.

The exploded view shown in FIG. 3 is contemplated as generally being the result of a die-cut process where the different layers of the upright figure 40 are made ready below the die so that, when the caricature 54 is punched out, the upright figure is intact, having well-defined borders and edges as a result of the die-cutting process. Clear adhesives or the like may be used to affix the different layers to one another in preparation for the die-cutting process. By use of high-quality, although not necessarily expensive, materials, an exceedingly attractive gift-package ornament may be produced that is visually attractive not only to those exchanging gifts but also to those consumers seeing such items on the display rack or other merchandising locations.

During the die-cutting process, the holes 12 may be die cut to provide holes on the order of 7/64ths or 1/8th inch in diameter. Such diameter of the die-cut holes 12 provide a snug fit for 3/16ths-inch ribbon that is commonly available. When the 3/16th-inch ribbon is passed through the holes 12, the gift-package ornament 10 may then interactively engage the ribbon R and the gift G itself. The snug fit provided by the holes 12 is sufficient to hold the 3/16ths-inch ribbon in place without a knot. Ribbons of other sizes may also be used, especially ribbons of greater width. Ribbons of shorter widths may require additional support as the snugness of the fit provided by the holes 12 may be diminished. The holes 12 may also be formed in larger or smaller diameters.

Figure 4:
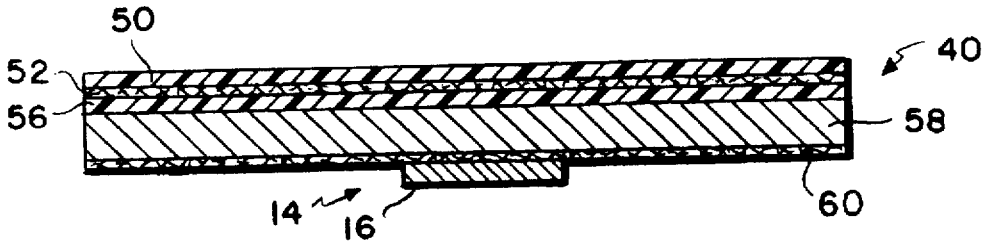
FIG. 4 is a cross-sectional view of the gift-package ornament of FIG. 2 taken along line 4—4.

As shown in FIG. 4 ( a cross section of FIG. 2), the different layers of the upright FIG. 40 are adjacent when the upright figure 40 is completely constructed.

As contemplated in the present invention, the top, clear laminating layer 50 may be approximately ten-thousandths-inch (0.010") thick. The caricature 54 may be printed on 100-pound book-stock paper and coated with an aqueous coating in preparation for lamination of the caricature. The second and rear lamination 56 may be approximately ten thousandths of an inch (0.010") thick with the magnetic sheet approximately thirty thousandths of an inch (0.030") thick. The paper backing sheet may be stock white paper and may be silk-screened in black ink with lettering or line art. The flexible base may be made of a soft metal (as for a bracket) with adhesive at least upon distal end 20 but also possibly along the central base extension 18 so that a greater adhering surface area may engage the gift surface S of gift G.

While the magnetic sheet 58 is not critical to the present invention as a gift-package ornament, it does add to the allure and attractive nature of the gift-package ornament 10 of the present invention as it allows the upright figure 40 to serve as a memento of the festive occasion at which the gift G was exchanged. Additionally, the upright figure 40 may act as a memento of the gift itself and the kind thoughts that went into its giving.

Generally, once gifts are opened, those things in which they were wrapped are discarded. However, the magnetic sheet 58 serves as means by which the gift-package ornament 10 may have an extended useful life. Once the gift-package ornament 10 has served its purpose, the upright figure 40 may be maintained by carefully removing the flexible base 14 from the rear backing sheet 60 of the upright figure 40. A magnetic figure is now in the possession of the gift recipient and may be used as a refrigerator or kitchen magnet or the like. As the caricature 54 of the upright figure 40 may be humorous, pleasant, festive, or otherwise sentimental, the upright figure provides a second gift to the gift recipient beyond that which was contained within the wrappings of the gift G.

As set forth above, a monster caricature is shown in FIGS. 1A–3. However, other caricatures may be provided that enhance the utility of the present invention as it may provide adaptable embodiments to the occasions and/or the accompanying gift wrapping where gifts are exchanged. Below is a brief summary of the different caricature 54 embodiments set forth in FIGS. 5A–5I.

Figure 5A:
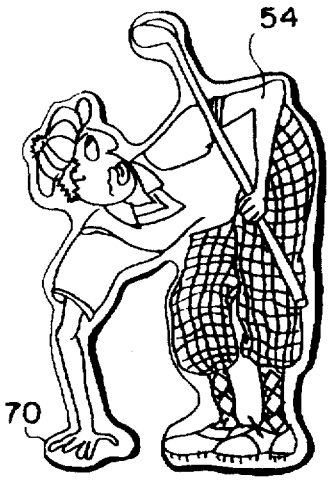
FIG. 5A–5I are alternative caricature embodiments of the gift-package ornament of the present invention.

In FIG. 5A, the caricature 54 is of a golfer. The golfer's right hand 70 is apparently near the ground and can be placed in a small ribbon bundle as if the golfer were searching through the rough for his golf ball. The bundle of ribbon would therefore be acting as a symbolic representation of the golf course rough and gifts given to golfers with such a gift-package ornament 10 would be well received and provide some delight to both parties of the gift exchange.

Figure 5B:
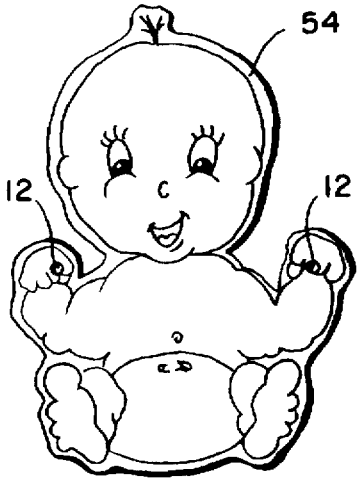

FIG. 5B shows a happy, smiling infant. Holes 12 are present at the hands of the infant to hold a ribbon so that it may interact with the gift much in the same way as the golfer's right hand 70 does in FIG. 5A.

Figure 5C:
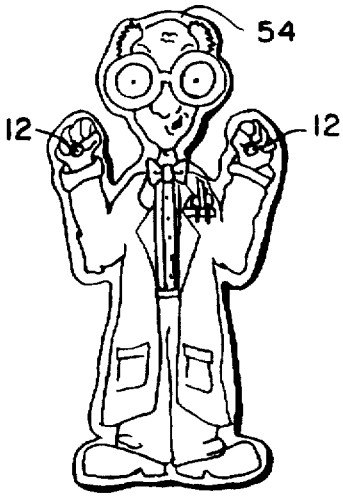

In FIG. 5C, a professorial caricature 54 is shown also with holes 12 in its hands so that it may hold a ribbon in order to interact with the gift.

Figure 5D:
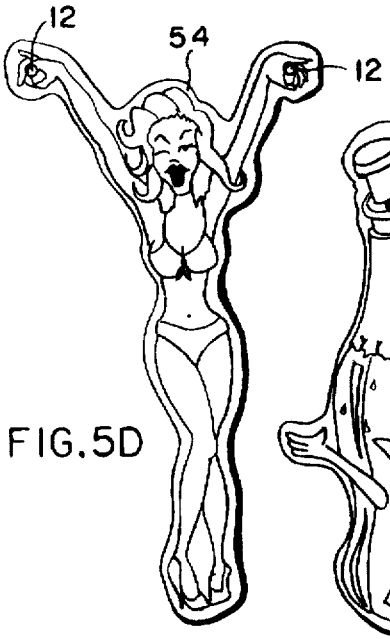

In FIG. 5D, a bathing-beauty caricature 54 also has holes 12 at its hands to engage a ribbon.

Figure 5E:
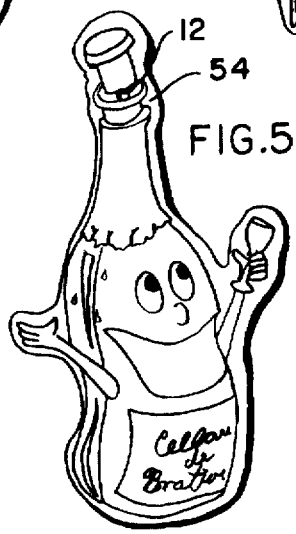

FIG. 5E shows a champagne-bottle caricature 54 having a hole 12 near the mouth of the bottle from which the cork is popping.

Figure 5F:
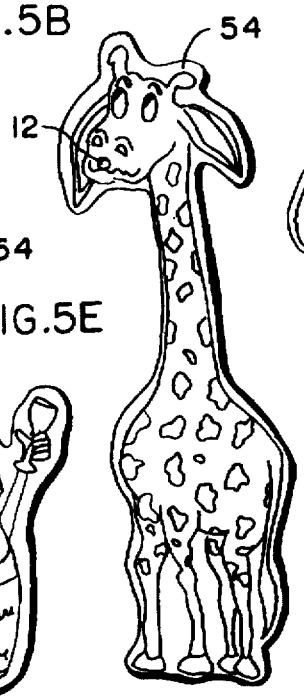

FIG. 5F shows a giraffe caricature 54 having a hole 12 in its mouth.

Figure 5G:
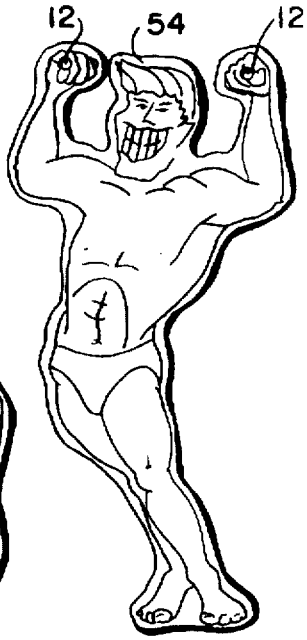

FIG. 5G shows a body-builder caricature 54 having holes 12 at its hands.

Figure 5H:
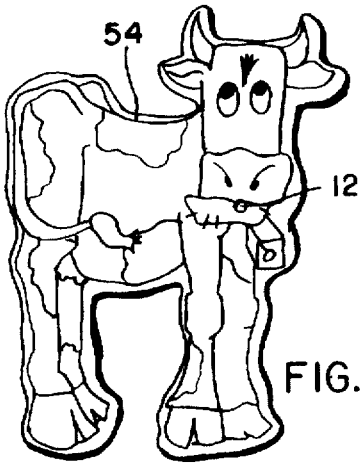

FIG. 5H shows a cow caricature 54 having a hole 12 in its mouth.

Figure 5I:
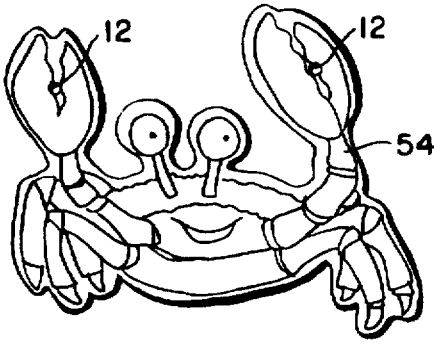

FIG. 5I shows a crab caricature 54 having holes 12 at its claws.

While the present invention has been described with regards to particular embodiments, it is recognized that additional variations of the present invention may be devised without departing from the inventive concept.

What I claim is:

1. A gift-package ornament for decorating a gift package, comprising:

an upright figure; and a flexible base, said flexible base coupled to said upright figure and attachable to the gift package, said flexible base able to hold said upright figure upright and away from a surface of the gift package; whereby the gift package may be decorated by attaching said upright figure to the gift package, said flexible base stably holding said upright figure to the gift package.

2. The gift-package ornament of claim 1, further comprising:

said flexible base being generally parallel to said upright figure for storage and transport and being generally perpendicular to said upright figure when said upright figure is attached to the gift package.

3. The gift-package ornament of claim 1, wherein said flexible base is adhesively attached to said upright figure and adhesively attachable to the gift package.

4. The gift-package ornament of claim 1, wherein said upright figure is magnetic.

5. The gift-package ornament of claim 1, wherein said upright figure has a caricature on a front side.

6. The gift-package ornament of claim 1, wherein said upright figure may be inscribed with indicia on a back side.

7. The gift-package ornament of claim 1, wherein said upright figure is die cut.

8. The gift-package ornament of claim 1, wherein said upright figure comprises:

a laminated caricature;

a magnetic sheet backing said laminated caricature; and a paper sheet backing said magnetic sheet; whereby said upright figure is lightweight and resilient and upon separation from said flexible base may be used as a decoration as for a refrigerator.

9. The gift-package ornament of claim 8, wherein said laminated caricature comprises:

a first lamination of clear plastic approximately ten-thousandths-inch (0.010") thick;

a caricature printed on 100-pound book-stock paper and coated with an aqueous coating in preparation for lamination of said caricature, said caricature laminated on a front side by said first lamination; and a second lamination approximately ten-thousandths-inch (0.010") thick, said second lamination laminating a rear side of said caricature.

10. The gift-package ornament of claim 8, wherein said magnetic sheet is approximately thirty-thousandths-inch (0.030") thick.

11. The gift-package ornament of claim 1, wherein said upright figure may snugly hold a ribbon wrapped around the gift package.

12. The gift-package ornament of claim 11, wherein said upright figure defines at least one hole through which said ribbon may pass and be snugly held by said upright figure.

13. A gift-package ornament for decorating a gift package, comprising:

a laminated caricature;

a magnetic sheet backing said laminated caricature;

a paper sheet backing said magnetic sheet and inscribable with indicia as for a greeting card;

said laminated caricature, said magnetic sheet, and said paper sheet all being die cut and together forming a lightweight and resilient upright figure, said upright figure defining at least one hole and able to snugly hold a ribbon wrapped around the gift package when said ribbon is passed through said hole; and a flexible base, said flexible base attached to said upright figure and adhesively attachable to the gift package, said flexible base able to hold said upright figure upright and away from a surface of the gift package, said flexible base being generally parallel to said upright figure for storage and transport and being generally perpendicular to said upright figure when said upright figure is attached to the gift package; whereby the gift package may be decorated by attaching said upright figure to the gift package, said flexible base stably holding said upright figure to the gift package and upon separation of said upright figure from said flexible base, said upright figure may be used as a decoration as for a refrigerator.

14. The gift-package ornament of claim 13, wherein said laminated caricature comprises:

a first lamination of clear plastic approximately ten-thousandths-inch (0.010–) thick;

a caricature printed on 100-pound book-stock paper and coated with an aqueous coating in preparation for lamination of said caricature, said caricature laminated on a front side by said first lamination; and a second lamination approximately ten-thousandths-inch (0.010") thick, said second lamination laminating a rear side of said caricature.

15. The gift-package ornament of claim 14, wherein said magnetic sheet is approximately thirty-thousandths-inch (0.030") thick and said hole is approximately one-eight inch (0.125") in diameter to snugly engage three-sixteenths-inch (3/16", 0.1875") ribbon.

16. A gift-package ornament for decorating a gift package having a ribbon, comprising:

an upright figure defining an aperture for holding the ribbon;

a flexible base, said flexible base coupled to said upright figure and attachable to the gift package having the ribbon, said flexible base able to hold said upright figure upright and away from a surface of the gift package; and said upright figure engaging the ribbon by means of said aperture so that the ribbon is removed from contact with the gift package; whereby the gift package may be decorated by attaching said upright figure to the gift package, said flexible base stably holding said upright figure to the gift package, and said upright figure holding up said ribbon to further enhance decoration of the gift package.

* * * * *